US012221852B1

(12) United States Patent
Shukla et al.

(10) Patent No.: US 12,221,852 B1
(45) Date of Patent: Feb. 11, 2025

(54) BULK METALLIC GLASS (BMG) SEALS FOR DOWNHOLE APPLICATIONS

(71) Applicant: Halliburton Energy Services, Inc., Houston, TX (US)

(72) Inventors: Shashwat Shukla, Singapore (SG); Arpana Singh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/228,135

(22) Filed: Jul. 31, 2023

(51) Int. Cl.
*E21B 33/12* (2006.01)
*C22C 45/10* (2006.01)

(52) U.S. Cl.
CPC ..... *E21B 33/1212* (2013.01); *C22C 45/10* (2013.01); *C22C 2200/02* (2013.01)

(58) Field of Classification Search
CPC ..... E21B 33/1212; E21B 33/1216
See application file for complete search history.

(56) References Cited

U.S. PATENT DOCUMENTS 4,406,469 A * 9/1983 Allison ..... E21B 33/1216 277/944
8,916,087 B2 12/2014 Schroers et al.
9,840,887 B2 * 12/2017 Zhao ..... E21B 33/1208
10,066,276 B2 9/2018 Pham et al.
10,626,695 B2 * 4/2020 Fripp ..... E21B 33/129
10,876,374 B2 * 12/2020 Mhaskar ..... E21B 33/1293
2009/0194205 A1 * 8/2009 Loffler ..... C22C 45/10 148/403
2014/0016253 A1 * 1/2014 Lee ..... H05K 7/14 106/287.18
2015/0337615 A1 * 11/2015 Epstein ..... E21B 33/134 166/65.1
2016/0145965 A1 * 5/2016 Zhao ..... E21B 33/1208 166/387
2016/0333657 A1 * 11/2016 Zhao ..... E21B 33/1212
2018/0135369 A1 5/2018 Parekh et al.
2018/0245422 A1 * 8/2018 Fripp ..... E21B 33/12
2021/0396101 A1 * 12/2021 Fripp ..... E21B 33/12
2023/0167263 A1 6/2023 Shukla et al.

OTHER PUBLICATIONS

International Search Report and Written Opinion for International Patent Application No. PCT/US2023/031053 dated Apr. 24, 2024. PDF file. 8 pages.
Zhong, A. (2016). Challenges for High-Pressure High-Temperature Applications of Rubber Materials in the Oil and Gas Industry. Conference Proceedings of the Society for Experimental Mechanics Series, 65-79.
Hertz, D. (2012). Elastomers in CO2. Presented at the High Performance Elastomers & Polymers for Oil & Gas. Aberdeen, SCO, UK.

(Continued)

*Primary Examiner* — Jennifer H Gay
(74) *Attorney, Agent, or Firm* — Scott Richardson; C. Tumey Law Group PLLC

(57) ABSTRACT

A variety of methods and apparatus are disclosed, including, in one embodiment, a downhole tool for use in a borehole, comprising: a mandrel; and a sealing element disposed about the mandrel, wherein the sealing element comprises bulk metallic glass (BMG).

16 Claims, 3 Drawing Sheets

(56) References Cited

OTHER PUBLICATIONS

J. Shen; G. Wang; J.F. Sun; Z.H. Stachurski; C. Yan; L. Ye; B.D. Zhou (2005). Superplastic deformation behavior of Zr41.25Ti13.75Ni10Cu12.5Be22.5 bulk metallic glass in the supercooled liquid region, Intermetallics 13 (2005), 79-85.
Greer, A. L.; Ma, E. (2007). Bulk Metallic Glasses: At the Cutting Edge of Metals Research. MRS Bulletin, 32(8), 611-619.
Jan Schroers (2005). The superplastic forming of bulk metallic glasses, 35-39.
B. Gun; K.J. Laws; M. Ferry (2006). Superplastic flow of a Mg-based bulk metallic glass in the supercooled liquid region. Journal of Non-Crystalline Solids 352(2006), 3896-3902.
Yang, Na; Yi, Jun; Yang, Yu Hang; Huang, Bo; Jia, Yan Dong; Kou, Sheng Zhong; Wang, Gang (2020). Temperature Effect on Fracture of a Zr-Based Bulk Metallic Glass. Materials 2020, 13, 2391, pp. 1-9.
Inoue, Akihisa; Shibata, Tsutomu; Zhang, Tao (1995). Effect of Additional Elements on Glass Transition Behavior and Glass Formation Tendency of Zr—Al—Cu—Ni Alloys. Materials Transactions, JIM, 36(12), 1420-1426.
Rothon, R. (2017). Particulate Fillers in Elastomers. Polymers and Polymeric Composites: A Reference Series, 125-146.
Gibson, Michael A.; Mykulowycz, Nicholas M.; Shim, Joseph; Fontana, Richard; Schmitt, Peter; Roberts, Andrew; Ketkaew, Jittisa; Shao, Ling; Chen, Wen; Bordeenithikasem, Punnathat; Myerberg, Jonah S.; Fulop, Ric; Verminski, Matthew D.; Sachs, Emanuel M.; Chiang, Yet-Ming; Schuh, Christopher A.; John Hart, A.; Schroers, Jan. 2018. 3D printing metals like thermoplastics: Fused filament fabrication of metallic glasses. Materials Today,1-6.
Plastics, Extrusion Processing Guide: TPE—Thermoplastic Elastomers, Jul. 25, 2015. Accessed Jul. 31, 2023, Available at https://www.plastics.gl/extrusion-profile/extrusion-processing-guide-tpe-thermoplastic-elastomers/.
Vannessa Goodship, ARBURG, Practical Guide to Injection Moulding, 2004.

* cited by examiner

BULK METALLIC GLASS (BMG) SEALS FOR DOWNHOLE APPLICATIONS

BACKGROUND

Boreholes may be drilled into subterranean formations to recover valuable hydrocarbons, among other functions. Operations may be performed before, during, and after the borehole has been drilled to produce and continue the flow of the hydrocarbon fluids to the surface. A borehole may be labeled as a wellbore.

A typical operation concerning downhole applications may be to apply a seal within a borehole. A seal may isolate and contain produced hydrocarbons and pressures within the borehole. There may be a variety of different tools and equipment used to create seals between the outside of a production tubing string and the inside of a casing string, liner, or the wall of a wellbore. Substantial pressure differentials across a seal may induce failure of the seal and may result in substantial loss of time, money, and equipment, and may even result in harm to individuals. Additionally, expanding a wellbore seal may induce substantial deformation and internal stress on a sealing element, which may increase the chance of failure (e.g., due to breaking or tearing). The design and manufacture of wellbore seals may be limited in structure and material choice in order to reduce the chance of failure. It may be suitable to explore alternative manufacturing techniques to produce improved sealing elements.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
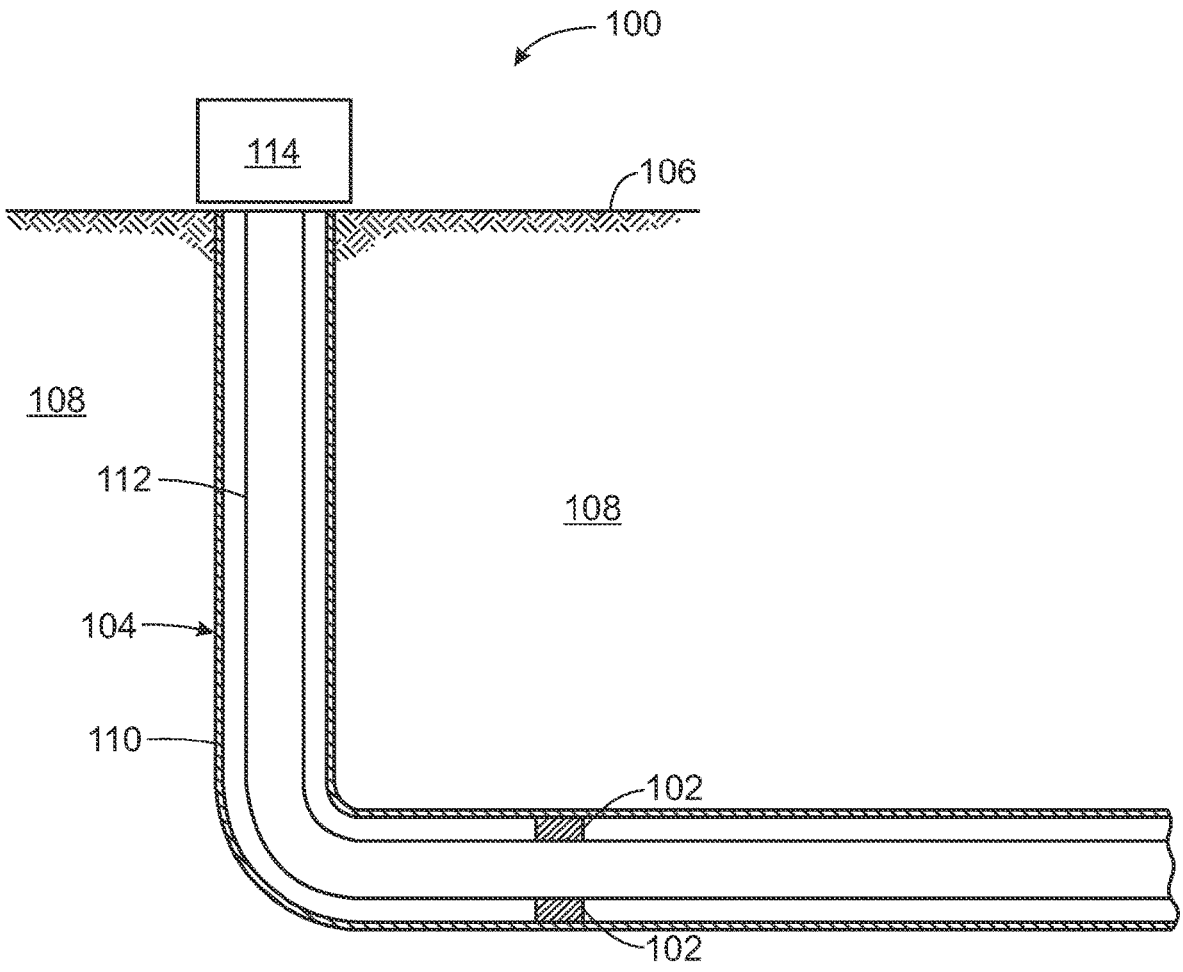
FIG. 1 is a diagram of a well site that includes a packer in a wellbore.

Disclosed herein are sealing elements that include bulk metallic glass (BMG) that are solid non-crystalline metallic alloys having strength, hardness, and elasticity. The sealing elements (seals) having the BMG may be for downhole tools, such as packers. Embodiments include the BMG having zirconium as the major element in that the BMG has at least 40 atomic percent (at %) of zirconium. Implementations herein of BMG for sealing elements include BMG having an amorphous structure with no nanocrystalline phases.

BMGs, also known as metallic glass, amorphous metal, amorphous alloy, or glassy metal, are metal alloys having a disordered atomic-scale structure (glass-like) that is amorphous (non-crystalline) and exhibits electrical conductivity and metallic luster. BMG can be produced, for example, by rapid cooling, physical vapor deposition, solid-state reaction, ion irradiation, and mechanical alloying. BMG may be considered true glasses in that BMG softens and flows upon heating, facilitating processing, such as by injection molding, similar to thermoplastic polymers. BMGs are tougher and less brittle than oxide glasses and ceramics.

BMGs can be a metal alloy, for example, of three or more of the following: zirconium (Zr), copper (Cu), silver (Ag), aluminum (Al), titanium (Ti), nickel (Ni), niobium (Nb), chromium (Cr), tantalum (Ta), beryllium (Be), magnesium (Mg), lanthanides (general symbol Ln), palladium (Pd), calcium (Ca), platinum (Pt), gold (Au), iron (Fe), cobalt (Co), yttrium (Y), and hafnium (Hf). For a metal present in the BMG (alloy) at least 40 atomic percent (at %), the BMG may be labeled as based on that metal. For instance, a BMG having Mg at least 40 at % can be called an Mg-based BMG. Likewise, a BMG having Zr at least 40 at % can be called a Zr-based BMG.

In implementations herein, the BMG a Zr-based BMG. Thus, the major element (greater than 40 at %) in the BMG is Zr. In addition to Zr, the BMG has at least two minor elements in the alloy that can include Cu, Ag, Al, Ti, Ni, Nb, Cr, Ta, or Be. In examples, this Zr-based BMG is an amorphous structure without nanocrystalline phases.

Seals may have a range of combinations of mechanical and chemical properties to satisfy functional demands. These demands may become more stringent in certain applications, such as high pressure-high temperature (HPHT), hydrogen storage, CCUS (carbon capture, utilization and storage), and the like. HPHT conditions may cause rapid decline in the modulus (e.g., Young's modulus), strength (ability to withstand an applied load without failure or plastic deformation), and elongation (elongation at break) of seals. Decrease in modulus and strength may cause the seal to extrude through the clearance when pressure differentials are relatively large. Reduction in elongation may cause the seal to fracture. Absorption of gases, such as hydrogen sulfide ($H_2S$), $H_2$, and $CO_2$, and supercritical $CO_2$ may lead to rapid gas decompression (RGD), which can fracture elastomeric seals. In some applications, exposure to gases is also accompanied with a relatively high service temperature, e.g., −80° C. in CCUS or greater than 175° C. in HPHT, accelerating the failure.

Conventional seals (elastomeric seals) generally tend to swell when they interact with water or oil. Swelling results in changes in volume, thickness, density, hardness and other mechanical properties, leading to reduced performance with time. Elastomeric seals can be sensitive to (attacked and degraded by) chemicals and generally cannot withstand abrasive or erosive media. Examples of elastomers or elastomer material utilized as elastomer seals (sealing elements) include natural rubbers, styrene-butadiene block copolymers, polyisoprene, polybutadiene, ethylene propylene rubber, ethylene propylene diene rubber, silicone elastomers, fluoroelastomers, polyurethane elastomers, and nitrile rubbers. Examples of non-elastomeric material utilized for downhole seals or back-up rings include polyphenylene sulfide (PPS), polyether ether ketone (PEEK), and polytetrafluoroethylene (PTFE).

A challenge can be to design seals that [1] do not measurably absorb gases, water, or oil, [2] have relatively high resistance to abrasion and erosion, [3] are generally not sensitive (or relatively low sensitivity) to chemicals, and [4] maintain a specified (beneficial) modulus, strength, and elongation over a wide range of pressures and temperatures likely in downhole service conditions. In response, embodiments herein include seals made of BMG that address these functional and property issues.

BMG as a structural alloy has high strength and high modulus—generally superior to conventional structural alloys. This is combined with BMG having high-temperature elongation that supersedes even the room temperature elongation of most elastomers. Additionally, BMG is generally chemically inert (when exposed to most chemicals and having a relatively low corrosion rate when exposed to strong acids), and being metallic in nature, generally does not absorb gases or fluids. With respect to chemical sensitivity, BMG corrode when exposed to strong acids. However, their chemical resistance is superior to elastomers and even most corrosion resistance alloys. For instance, for immersion corrosion in 6 molar (M) hydrochloric acid (HCl), an example of a nickel-chromium based BMG corrodes at 0.03 millimeter per year (mm/year), which is about 1-2 orders of magnitude less than stainless steel 316L that corrodes at about 1 mm/year. Because of this combination of characteristics, BMGs are a beneficial material to expand the performance envelope of seals. Embodiments include seals having BMG for downhole applications. The BMG—its chemistry and microstructure—may give extrusion resistance, thermal resistance, RGD resistance, chemical resistance, and resistance to swelling, abrasion and erosion.

Techniques for producing the BMG seal may be based on, for example, rapid solidification that can be performed by melt-spinning, splat-quenching, micro-injection molding, suction casting, rapid discharge forming, superplastic forming, or any other similar technique that can solidify and shape the molten BMG without its crystallization. Technique for setting the BMG seal can involve its deformation at or above the glass transition point, so the BMG flows superplastically to fill and conform to the geometry of the annulus. With time, the BMG will generally set the seal and in implementations, may crystallize.

The seal may be BMG with or without filler material in the BMG. The BMG may incorporate filler material, such as nanofillers including, for example, carbon nanotubes (CNT) or nanocrystalline metals (nanometal). CNT-BMG and nanometal-BMG composites may be implemented in those examples. On the other hand, the seal may be elastomer material having BMG as filler. Implementations include incorporation of BMG fillers in an elastomer to make composite seals with improved performance.

Implementations of the BMG seals (e.g., Zr-based BMG) as disclosed herein have [1] high yield strength, such as about 2000 megapascals (MPa) or in the range of 1500 MPa to 2500 MPa, and [2] high modulus of elasticity (Young's modulus), such as about 100 gigapascals (GPa) or in the range of 50 GPa to 150 GPa, combined with [3] high fracture toughness, such as about 100 MPa*meter$^{1/2}$(MPa*m$^{1/2}$) or in the range of 50 MPa*m$^{1/2}$ to 150 MPa*m$^{1/2}$. These values are two orders of magnitude greater compared to typical elastomeric seals, which have strength and modulus in the range of 10-30 MPa, and fracture toughness only around 1 MPa*m$^{1/2}$. As a result of improved crack resistance and load bearing capability, once the BMG seal is set and installed downhole, the BMG seal may withstand relatively large pressure differentials without extruding through the clearance. Additionally, after the seal is set, exposure to high temperature (e.g., greater than 300° C., or in the range of 300° C. to 500° C.) or low temperature (e.g., less than −190° C., or in the range of −300° C. to −190° C.) generally does not cause the seal (BMG) to crack in implementations herein. Conversely, conventional elastomeric seals fracture at such temperatures. Further, seals made of BMGs generally not absorb water, oil, or gases and will experience little or no RGD damage. Elastomeric seals typically cannot offer a comparable fluid resistance. BMG seals can resist damage due to formation fluids and offer orders of magnitude higher resistance to abrasion and erosion, compared to conventional seals.

Table 1 is a comparison of properties of Zr-based BMG with properties of typical elastomers utilized for seals in downhole applications. Functional issues are noted. The comments and property numerical values in Table 1 are given as examples and not intended to limit the present techniques. For BMGs, values of strength, hardness, elongation, fracture toughness, critical casting diameter, and glass transition temperatures are discussed herein for embodiments BMGs. In other embodiments, where service conditions permit, alternative BMGs with lower values can also be used.

TABLE 1

Function comparison of a Zr-based BMG and typical elastomers for seals

| Function | Corresponding Material Property | BMG | Elastomer |
|---|---|---|---|
| Extrusion resistance | Yield Strength (MPa) | 2000 | 10-30 |
| | Modulus (GPa) | 100 | 0.01-0.03 |
| High-temp compatibility | % Elongation (>300° C.) | >1500 | <20 |
| Low-temp compatibility | | −196° C. or colder | −65° C. to −1° C. (glass transition) |
| RGD resistance | Gas absorption | Not susceptible | Highly susceptible |
| Swelling resistance | Water/oil absorption | Not susceptible | Highly susceptible |
| Abrasion/erosion resistance | Hardness (MPa) | >6500 | <100 |
| Crack growth resistance | Fracture toughness (MPa * m$^{1/2}$) | 100 | <1 |
| Chemical compatibility | | Excellent | Weak to moderate |
| Processability | Thermoplastic-like processing/forming | Straight-forward | Difficult |

For BMGs (e.g., Zr-based BMGs), their strength beneficially combines with their elastic modulus that considerably exceeds the modulus of elastomers. Additionally, at certain elevated temperatures, BMGs can flow like a viscous fluid making the BMGs processable, similar to thermoplastics. Elastomers do not offer a comparable formability unless a thermoplastic filler is added to the elastomeric matrix. Another implication of the non-crystalline BMG superplastic-like behavior is giving significant high-temperature elongation. This behavior of BMGs can be harnessed to deform the seal and make the seal conform to the desired geometry during setting.

The BMG seal can be set when it is in a supercooled state between its glass transition and crystallization temperature. After setting, it can be used at any service temperature that falls below its glass transition temperature (e.g., at least 300° C.) down to the cryogenic range (e.g., −150° C.).

FIG. 1 is a well site 100 that includes a packer 102 in a wellbore 104. The packer 102 has a seal (sealing element) that is or includes BMG. In implementations herein, the BMG has or is an amorphous structure without nanocrystalline phases. As indicated, the major element (at least 40 at %, such as in the range of 40 at % to 80 at %) in the BMG is Zr in examples. In addition to Zr, the BMG has at least two minor elements (each less than 40 at %), in the alloy that can include Cu, Ag, Al, Ti, Ni, Nb, Cr, Ta, or Be. The composition of the BMG is configured such that the BMG glass transition temperature is, for example, at least 300° C. or in the range of 300° C. to 500° C. The composition of the BMG may be configured to have a high glass formability, manifested by a critical casting diameter of at least 20 millimeters (mm). In embodiments, this high glass formability permits the BMG to maintain an amorphous structure up to a seal thickness of 20 mm without forming a nanocrystalline phase(s). The absence of nanocrystals can be confirmed by transmission electron microscopy (TEM).

In implementations, the composition and amorphous structure of the BMG for the downhole seal are configured such that the BMG has a high strength (e.g., at least 1000 MPa) and a high modulus (e.g., at least 70 GPa), facilitating the seal to resist extrusion when subjected to relatively large pressure differentials, e.g., a pressure differential of 2000 pounds per square inch (psi) with a 0.01 inch total diametral clearance. The BMG may have a hardness for the seal to withstand abrasive and erosive service conditions. For example, the hardness may be greater than 500 Vickers hardness number (HV), or in the range of 500 HV to 1000 HV. The BMG can have a high fracture toughness (>50 $MPa*mm^{1/2}$) between −150° C. to 300° C., preventing or reducing potential crack growth when the BMG subjected to extreme service temperatures. The superplastic-like behavior for the non-crystalline BMG can give elongation of at least 400%. While the BMG is generally not a crystalline structure, the BMG can act as a superplastic (in a state of superplasticity). The superplastic-like flow of the BMG facilitates setting of the BMG seal in a temperature range that falls at or above its glass transition point, which can vary between 300° C. to 500° C., depending on the BMG composition. After setting, the seal can be utilized between −150° C. and the glass transition temperature of the BMG. The superplastic-like flow imparts processability and facilitates the fabrication of BMG seal by thermoplastic-like forming, similar to the molding of thermoplastics. The BMG seal generally does not swell in water/oil and is resistant to gas absorption/RGD damage.

The wellbore 104 is formed through the Earth surface 106 into a subterranean formation 108 in the Earth crust. In the illustrated implementation, the wellbore 104 has a casing 110 and is therefore a cased wellbore. Cement (not shown) may be disposed between the casing 110 and the formation 108 face. The formation 108 face can be considered a wall of the wellbore 104.

Perforations may be formed through the casing 110 (and cement) for entry of fluid (e.g., hydrocarbon, water, etc.) from the subterranean formation 108 into the wellbore 104 to be produced (routed) as produced fluid through production tubing 112 to the surface 106. The surface equipment 114 may include a wellhead for receipt of the produced fluid. In other implementations, the wellbore 104 can be utilized for injection of fluid from the surface 106 through the wellbore 104 and the perforations in the casing 110 (and cement) into the subterranean formation 106.

The surface equipment 114 can include a hoisting apparatus (e.g., for raising and lowering pipe strings) and a derrick. The surface equipment 114 and equipment deployed in the wellbore 104 can include equipment, such as a wireline, slickline, coiled tubing, tubing string, pipe, drill pipe, drill string, and the like, that facilitates mechanical conveyance for deploying downhole tools (e.g., packer 102 and other tools). The deploying of the downhole tool (e.g., packer 102) may include lowering the downhole tool into the wellbore 104 from the surface 106 and setting (e.g., via mechanical slips) the downhole tool in the wellbore 104. In some implementations for the downhole tool as a packer 102, the equipment (e.g., wireline) may provide electrical connectivity, for example, to actuate the packer 102 to seal off a portion of the wellbore 104.

Again, the casing 110 may be secured within wellbore 104 by cement (not shown). The casing 110 may be, for example, metal, plastic, composites, and the like, and may be expanded or unexpanded as part of an installation procedure. Additionally, in implementations, the casing 110 is not cemented into the wellbore 104. The production tubing 112 may be a tubing string utilized in the production of hydrocarbons. The packer 102 may be disposed on or near production tubing 112.

Depending on the type of packer 102, the packer 102 may be permanently set or retrievable, mechanically set, hydraulically set, and/or combinations thereof. As will be discussed in more detail below, packer 102 may include one or more sealing elements (e.g., expandable seal elements 206, 208, 210 of FIG. 2). The packer 102 may be set downhole to seal off a portion of wellbore 104. When set, packer 102 may isolate zones of the annulus between casing 110 and the production tubing 112 (e.g., a tubing string) by providing a seal (fluid seal) between the production tubing 112 and the casing 110. In examples, the packer 102 may be disposed on the production tubing 112.

It should be understood by those skilled in the art that present examples are equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an onshore operation, it should be understood by those skilled in the art that the packer and its sealing elements of the present techniques is equally well suited for use in offshore operations. In addition, while FIG. 1 depicts use of the packer 102 in a cased portion of wellbore 104, it should be understood that a packer 102 may also be used in uncased portions (e.g., openhole portions) of wellbore 104.

Figure 2:
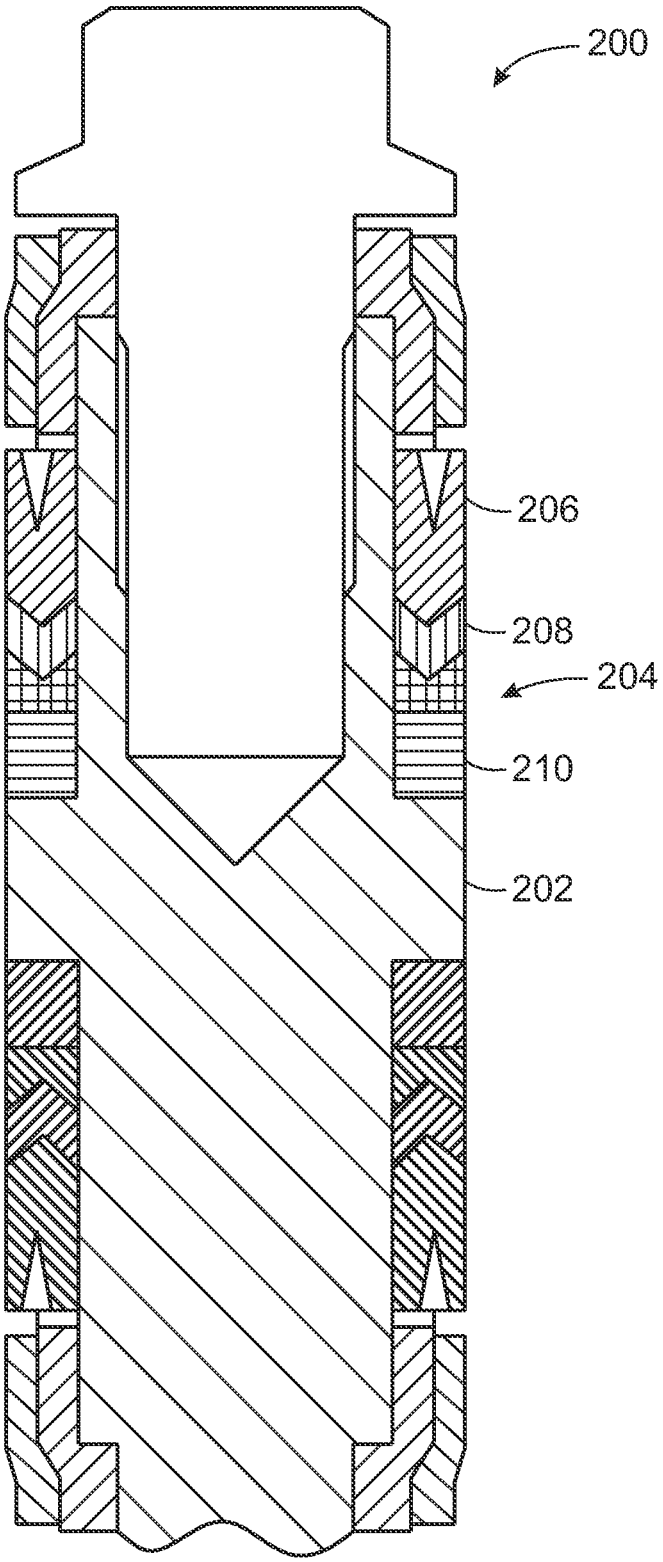
FIG. 2 is a diagram of a downhole tool (e.g., packer) having a sealing element including bulk metallic glass (BMG).

FIG. 2 is a downhole tool 200 (e.g., packer) to be disposed in a borehole (e.g., wellbore 104 of FIG. 1). The downhole tool 200 (e.g., packer analogous to the packer 102 of FIG. 1) as installed in the wellbore may be permanently set or retrievable, mechanically set, hydraulically set, and/or combinations thereof. A retrievable packer may be a type of packer that is run and retrieved on a running string or production string, unlike a permanent production packer that is set in the casing or liner before the production string is run.

A packer may be device that can be run into a wellbore with a smaller initial outside diameter that then expands externally to seal the wellbore. Packers may employ flexible, elastomeric elements that expand. A packer may be a production packer, test packer, isolation packer, etc. A production packer may isolate the annulus (e.g., between the production tubing and the casing or wellbore wall) and anchor or secure the bottom of the production tubing string. A typical packer assembly incorporates a means of securing the packer against the casing or liner wall, such as a slip arrangement, and a means (e.g., sealing elements) of creating a reliable hydraulic seal to isolate the annulus, typically by means of an expandable elastomeric element. Packers are typically classified by application, setting method and possible retrievability.

The downhole tool 200 (e.g., packer) may include a mandrel 202 (tool mandrel) and a seal stack 204 disposed about the mandrel 202. The seal stack 204 may be an assembly of individual sealing elements 206, 208, 210 utilized to seal off a portion of the wellbore. One or more of the sealing elements 206, 208, 210 may be or include BMG. The material selection for the sealing elements may be to tailor properties of the sealing elements 206, 208, 210, such as hardness, elasticity, gas resistance, chemical resistance, temperature resistance, and high temperature strength, among others. As in the illustrated implementation, the individual sealing elements 206, 208, 210, within seal stack 204 may be of differing size, height, and/or shape. A shape may include, for example, cross-sectional shapes that are circular, elliptical, triangular, rectangular, square, hexagonal, irregular, and/or combinations thereof.

The seal stack 204 may provide for a fluid seal between the downhole tool 200 and the wellbore wall or casing (or liner), such that in the borehole or wellbore annulus, uphole of the downhole tool is fluidically sealed from downhole of the downhole tool. The downhole tool 200 may engage via the seal stack 204 an adjacent surface (e.g., wellbore wall, an inside surface of a casing, an inside surface of a liner, etc.) to form a seal (fluid seal) between the seal stack 204 and the adjacent surface. The seal stack 204 includes the top seal 206 for uphole position, the middle-positioned seal 208, and the bottom seal 210 on downhole side. The seals 206, 208, 210 may provide resilience, sealing efficiency, and extrusion resistance. A seal stack can have multiple seals with different respective materials to give different properties. As mentioned, in application, the seal stack 204 provides for a fluid seal in the wellbore between the seal stack 204 and the wellbore wall (e.g., formation face, casing, etc.), thereby isolating (e.g., the annulus) downhole of the downhole tool 200 from uphole of the downhole tool 200.

Again, the seal stack 202 includes the seals 206, 208, 210 (e.g., rings) that may be sealing elements that provide for a fluid seal in the wellbore between the seals 206, 208, 210 and the wellbore wall (e.g., casing). In implementations, the top seal 208 is an anti-extrusion backup ring to resist extrusion. To resist extrusion, the top seal 206 may have a higher temperature resistance than the seal 208 (e.g., an elastomer) and/or a higher Young's modulus than the seal 208. The top seal 206 can be, for example, a thermoplastic (e.g., PEEK) or BMG.

A problem with downhole packers can be extrusion (migration) of packer sealing elements into an annular gap between the packer body and the wellbore casing. The amount of extrusion can be a function of the differential pressure, working temperature, and size of the annular gap to the casing inside diameter. A back-up ring (e.g., top seal 206 in implementations) can reduce extrusion and therefore promote holding a seal stack to the outlined shape of the seal stack.

Embodiments include seal stacks having a sealing element (seal) that includes BMG, an O-ring or O-ring backup that includes BMG, a packer element (packer sealing element) or packer element backup that includes BMG, and other similar applications. Implementations include BMG as a seal material for downhole tools to give a downhole seal and/or downhole seal backup solution. The sealing element (seal or backup) may be or include Zr-based BMG.

Figure 3:
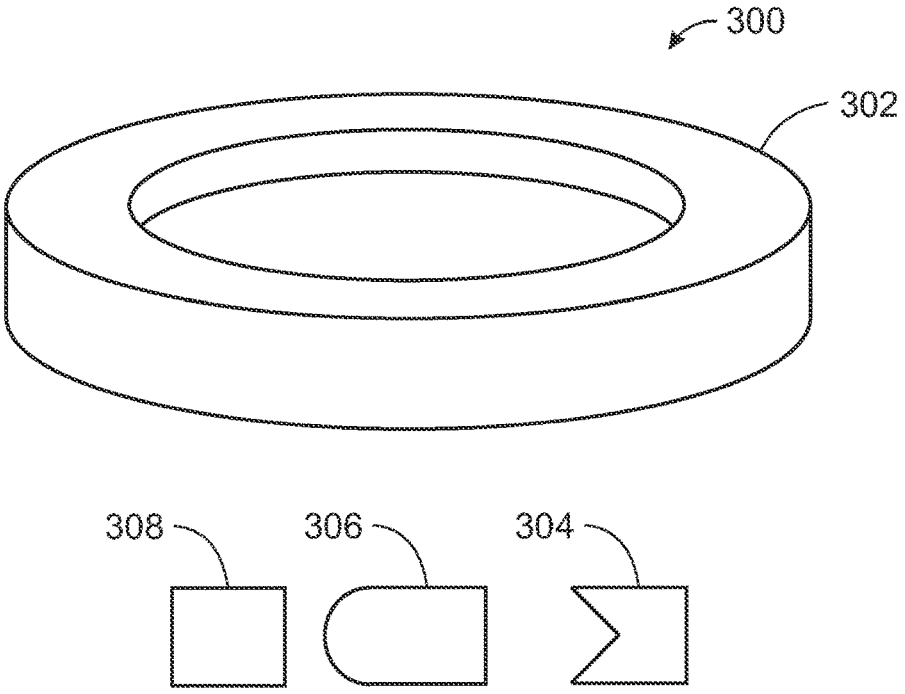
FIG. 3 is a diagram of sealing element that can include or be BMG.

FIG. 3 is a seal or sealing element 300 that can include or be BMG. The sealing element 300 is for a downhole tool, such as a packer. As depicted, the sealing element 300 may have a generally annular body 302 (e.g., ring-shaped, comprising a ring shape to be situated around a tool mandrel). In some embodiments, the annular body 302 may be circular and/or hollow. In examples, the sealing element 300 may be configured with cross-sectional shapes. For instance, the sealing element 300 may have a cross-section similar in shape to V-shape 304, D-shape 306, square 308, an irregular shape, and/or combinations thereof.

Figure 4:
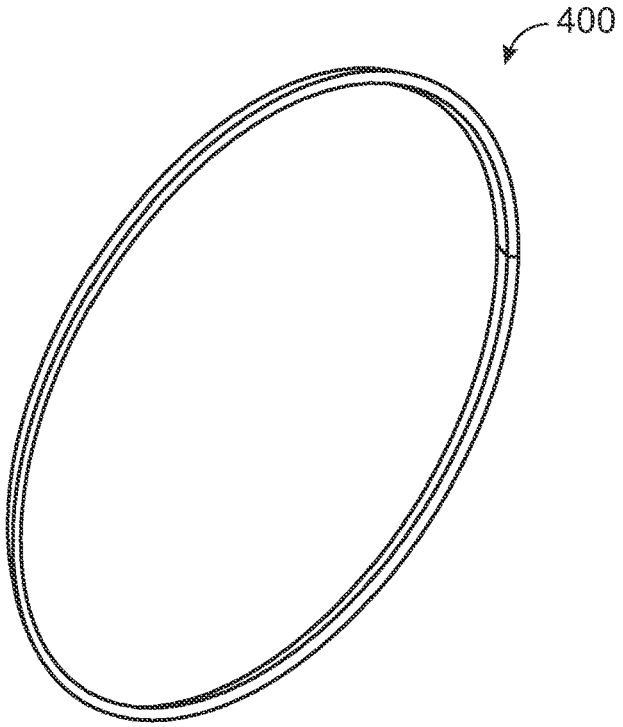
FIG. 4 is a diagram of an O-ring that can include or be BMG.

FIG. 4 is an O-ring 400. The O-ring 400 can be disposed on a mandrel (tool mandrel) of a downhole tool, such as a packer, to be disposed in a wellbore. The O-ring 400 can be or include BMG.

Applications of BMG may include seals, seal stacks, O-rings, anti-extrusion ring or backup (e.g., packer element backup), and so on, for downhole tools, such as packers. In implementations, the BMG can have filler material. In other implementations, the BMG can be filler material in a seal, such as in an elastomer seal. In examples, the sealing element may be a composite seal having BMG plus elastomer or other material.

In embodiments, BMG particles are utilized as fillers in an elastomeric seal to improve extrusion resistance, thermal resistance, and fluid resistance of the elastomer-based seal. In implementations, the amorphous BMG is designed such that the temperature at which it superplastically flows is comparable to the shaping temperature of the elastomer. In examples, the mixing and/or shaping of the elastomer and BMG particles can be performed with a coupling agent, where the coupling agent enhances the interfacial wetting of BMG particles on the elastomeric matrix. In examples, BMG particles are produced by mechanical milling of rapidly solidified BMG rods or BMG ribbons, or thermoplastically formed BMG ingots.

In embodiments, alternative materials, such as a thermoplastic elastomer/plastomer, or two-phase materials containing a plastic and a rubber component, can be used as a matrix with the BMG. In these cases, the matrix can be formed with BMG included in or as part of the matrix. In implementations, the matrix material can contain nanofillers, such as carbon nanotubes and/or clay nanopowders, to tailor the properties of the elastomer/BMG composite.

In another embodiment, BMG can be utilized as an overlay on the elastomer to improve a specific functionality, such as, the resistance to fluid absorption and RGD.

As mentioned, structure of BMGs is amorphous devoid of any nanocrystals in embodiments. In other embodiments, BMGs with nanocrystals in the range of 1 weight percent (wt %) to 10 wt % can be utilized to make the seal or the fillers for elastomeric seals.

BMG compositions can include one or more metalloids, e.g., boron (B), silicon (Si), carbon (C), phosphorus (P), etc. BMG compositions (alloying compositions) may include, for example, AuCuSi, PdCuSi, TiZrNiCu, PdCuNiP, MgZnCa, MgCuGd, CaMgCu, LaAlCoCuNi, FeCoCrMoCBY, PtNiCuP or MgNiMn, as well as their variants arising from different alloying additions can be utilized to make the seal or the fillers.

In embodiments, the BMG seal can be manufactured by additive methods, such as, fused disposition modelling or other rapid solidification techniques, such as blow molding.

Accordingly, the present disclosure may provide sealing elements that include bulk metallic glass. The methods, systems, and tools may include any of the various features disclosed herein, including one or more of the following statements.

Statement 1. A downhole tool for use in a borehole, comprising: a mandrel; a sealing element disposed about the mandrel, wherein the sealing element comprises bulk metallic glass (BMG).

Statement 2. The downhole tool of statement 1, wherein the sealing element is configured to interface with the borehole to form a fluid seal in the borehole.

Statement 3. The downhole tool of statement 1 or statement 2, wherein the downhole tool comprises a seal stack disposed about the mandrel, wherein the seal stack comprises the sealing element and a second sealing element that comprises an elastomer.

Statement 4. The downhole tool of any preceding statement, wherein the sealing element comprises an annular body.

Statement 5. The downhole tool of any preceding statement, wherein the BMG is an amorphous structure without nanocrystalline phases.

Statement 6. The downhole tool of any preceding statement, wherein the BMG comprises at least 40 atomic percent (at %) of zirconium (Zr).

Statement 7. The downhole tool of statement 6, wherein the BMG is a Zr-based BMG.

Statement 8. The downhole tool of statement 6, wherein the BMG comprises copper (Cu), silver (Ag), aluminum (Al), titanium (Ti), nickel (Ni), niobium (Nb), chromium (Cr), tantalum (Ta), or beryllium (Be), or any combinations thereof.

Statement 9. The downhole tool of any preceding statement, wherein the sealing element comprises an elastomer seal having the BMG as filler material.

Statement 10. The downhole tool of any preceding statement, wherein the downhole tool is a packer.

Statement 11. The downhole tool of any preceding statement, comprising an O-ring comprising BMG.

Statement 12. A method of sealing a borehole, comprising: moving a tool mandrel of a downhole tool to a selected position in the borehole, wherein a sealing element is disposed about the tool mandrel, wherein the sealing element comprises bulk metallic glass (BMG); and positioning the sealing element in the borehole to form a seal between the sealing element and an adjacent surface.

Statement 13. The method of statement 12, wherein the adjacent surface comprises a liner or casing in the borehole.

Statement 14. The method of statement 12 or statement 13, wherein the downhole tool comprises a seal stack disposed about the tool mandrel, wherein the seal stack comprises the sealing element and a second sealing element that comprises an elastomer.

Statement 15. The method of any one of statements 12-14, wherein the sealing element comprises an annular body.

Statement 16. The method of any one of statements 12-15, wherein the BMG is an amorphous structure without nanocrystalline phases.

Statement 17. The method of any one of statements 12-16, wherein the BMG comprises at least 40 atomic percent (at %) of zirconium (Zr).

Statement 18. The method of statement 17, wherein the BMG comprises copper (Cu), silver (Ag), aluminum (Al), titanium (Ti), nickel (Ni), niobium (Nb), chromium (Cr), tantalum (Ta), or beryllium (Be), or any combinations thereof.

Statement 19. The method of any one of statements 12-18, wherein the sealing element comprises an elastomer seal having the BMG as filler material.

Statement 20. The method of any one of statements 12-19, wherein the downhole tool is a packer.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole tool for use in a borehole, comprising:

a mandrel; and a seal stack disposed about the mandrel, wherein the seal stack comprises a sealing element that comprises bulk metallic glass (BMG), and wherein the seal stack comprises a second sealing element that comprises an elastomer.

2. The downhole tool of claim 1, wherein the sealing element is configured to interface with the borehole to form a fluid seal in the borehole.

3. The downhole tool of claim 1, wherein the sealing element comprises an annular body.

4. The downhole tool of claim 1, wherein the BMG is an amorphous structure without nanocrystalline phases.

5. The downhole tool of claim 1, wherein the BMG comprises at least 40 atomic percent (at %) of zirconium (Zr).

6. The downhole tool of claim 5, wherein the BMG is a Zr-based BMG.

7. The downhole tool of claim 1, wherein the downhole tool is a packer.

8. A downhole tool for use in a borehole, comprising:

a mandrel; and a sealing element disposed about the mandrel, wherein the sealing element comprises an elastomer seal having bulk metallic glass (BMG) as filler material.

9. A downhole tool for use in a borehole, comprising:

a mandrel;

a sealing element disposed about the mandrel, wherein the sealing element comprises bulk metallic glass (BMG); and a second sealing element comprising an O-ring comprising BMG.

10. A method of sealing a borehole, comprising:

moving a tool mandrel of a downhole tool to a selected position in the borehole, wherein a seal stack is disposed about the mandrel, wherein the seal stack comprises a sealing element that comprises bulk metallic glass (BMG), and wherein the seal stack comprises a second sealing element that comprises an elastomer; and positioning the sealing element in the borehole to form a seal between the sealing element and an adjacent surface.

11. The method of claim 10, wherein the adjacent surface comprises a liner or casing in the borehole.

12. The method of claim 10, wherein the sealing element comprises an annular body.

13. The method of claim 10, wherein the BMG is an amorphous structure without nanocrystalline phases.

14. The method of claim 10, wherein the BMG comprises at least 40 atomic percent (at %) of zirconium (Zr).

15. The method of claim 10, wherein the sealing element comprises an elastomer seal having the BMG as filler material.

16. The method of claim 10, wherein the downhole tool is a packer.

* * * * *